US008562306B2

(12) United States Patent
Kojima et al.

(10) Patent No.: US 8,562,306 B2
(45) Date of Patent: Oct. 22, 2013

(54) COMPRESSOR APPARATUS

(75) Inventors: Yoshihide Kojima, Hyogo (JP); Takaaki Ishida, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 158 days.

(21) Appl. No.: 12/988,599

(22) PCT Filed: Feb. 26, 2009

(86) PCT No.: PCT/JP2009/053512

§ 371 (c)(1),
(2), (4) Date: Oct. 19, 2010

(87) PCT Pub. No.: WO2009/133721

PCT Pub. Date: Nov. 5, 2009

(65) Prior Publication Data

US 2011/0038738 A1 Feb. 17, 2011

(30) Foreign Application Priority Data

Apr. 30, 2008 (JP) ..... 2008-118937

(51) Int. Cl.
*F04B 49/00* (2006.01)
*F16K 37/00* (2006.01)

(52) U.S. Cl.
USPC ..... 417/63; 137/556; 137/551

(58) Field of Classification Search
USPC ..... 417/415, 63, 550, 570, 440; 116/34 R, 116/267, 70; 137/511, 540, 543.17, 551, 137/556, 557, 227
See application file for complete search history.

(56) References Cited

U.S. PATENT DOCUMENTS

| | | | | | |
|---|---|---|---|---|---|
| 2,849,022 | A | * | 8/1958 | Kramer | 137/512.2 |
| 2,895,504 | A | * | 7/1959 | Lederer | 137/539 |
| 2,948,256 | A | * | 8/1960 | Tapp | 116/34 R |
| 3,276,446 | A | * | 10/1966 | Hay | 128/205.13 |
| 3,587,632 | A | * | 6/1971 | Clay | 137/543 |
| 3,738,311 | A | * | 6/1973 | Appleton | 116/272 |
| 3,799,037 | A | * | 3/1974 | Schmidt | 92/98 R |
| 4,029,042 | A | * | 6/1977 | Juhasz | 116/267 |
| 4,168,723 | A | * | 9/1979 | Schneider | 137/542 |

(Continued)

FOREIGN PATENT DOCUMENTS

| | | | |
|---|---|---|---|
| EP | 1 219 942 | A1 | 7/2002 |
| JP | 2005-344570 | A | 12/2005 |
| WO | WO 2005/042277 | A2 | 5/2005 |

*Primary Examiner* — Charles Freay
*Assistant Examiner* — Alexander Comley
(74) *Attorney, Agent, or Firm* — Birch, Stewart, Kolasch & Birch, LLP

(57) ABSTRACT

A compressor apparatus notifies a user whether compressed-air reaches a specified pressure without requiring a pressure gauge or the costs associated therewith. The compressor apparatus includes a motor M, a rotational shaft 11, a compressor main body 10 comprising a cylinder chamber 15, and a detector 7 that notifies the user that the pressure of the compressed-air supplied from the above-mentioned cylinder chamber 15 exceeds a reference pressure P. The detector 7 includes a valve main body 30 having a valve flow channel 30A having an exhaust port 33 and a switch valve 34 releasing the valve flow channel 30A to exhaust the compressed-air supplied from the exhaust port 33 when the compressed-air pressure exceeds the reference pressure P; and a detective cap 31 pushed up by the exhaust air pressure from the exhaust port 33 from the normal position Y1 to the protruding position Y2.

5 Claims, 8 Drawing Sheets

(56) References Cited

U.S. PATENT DOCUMENTS

| | | | | | |
|---|---|---|---|---|---|
| 4,333,491 | A * | 6/1982 | Knubley | 137/116.3 |
| 4,384,543 | A * | 5/1983 | Wong | 116/34 R |
| 4,726,223 | A * | 2/1988 | Huang | 73/146.8 |
| 4,877,143 | A * | 10/1989 | Travisano | 215/230 |
| 4,889,151 | A * | 12/1989 | Oten | 137/71 |
| 5,386,794 | A * | 2/1995 | Foss et al. | 116/34 R |
| 5,435,337 | A * | 7/1995 | Kemp | 137/220 |
| 5,462,082 | A * | 10/1995 | Lauria | 137/557 |
| 6,125,694 | A * | 10/2000 | Bledsoe | 73/146.8 |
| 6,846,162 | B2 * | 1/2005 | Chou | 417/63 |
| 6,866,062 | B2 * | 3/2005 | Lammers | 137/543 |
| 6,948,516 | B1 * | 9/2005 | Williams | 137/224 |
| 7,462,018 | B2 * | 12/2008 | Chou | 417/415 |
| 2004/0028533 | A1 * | 2/2004 | Chou | 417/63 |
| 2004/0146408 | A1 * | 7/2004 | Anderson | 417/63 |
| 2005/0186084 | A1 * | 8/2005 | Wang | 417/63 |
| 2005/0265873 | A1 * | 12/2005 | Chou | 417/552 |

* cited by examiner

COMPRESSOR APPARATUS

TECHNICAL FIELD

The present invention relates to a compressor apparatus being suitable to fill a tire with the air, being capable of notifying a user that a generated compressed-air pressure comes up to a reference pressure with high accuracy without using a pressure gauge, and being capable of filling up the tire with the air at the specified pressure previously indicated as the reference pressure.

BACKGROUND OF THE INVENTION

As a compressor apparatus to fill a tire with compressed-air, a compressor apparatus shown in FIG. 8 is proposed, for example (See Patent Document 1, for example). This apparatus (a) comprises

- a motor (b);
- a compressor main body (c) making generate compressed-air;
- an air-supplying means (d) letting go the generated compressed-air into a tire;
- a pressure gauge (e) measuring a pressure of the generated compressed-air; and
- a relief valve (f) as a safety valve to release an overpressure generated by the compressor main body (c).

The generated compressed-air is filled up to the tire by connecting the above-mentioned air-supplying means (d) to the tire and by driving the motor (b). At this time, a user looks at a pressure gauge (e) and recognizes that the compressed-air comes up to a specified pressure of filling the tire.

In the case of a passenger car, for example, the specified pressure of filling the tire is ordinarily in a range of from 200 to 250 kPa, and it is specified for car models. Therefore, to replenish the tire resulted in a reduction of pressure in use with the air or to fill up the punctured tire with the air, it requires the user to inflate the air while watching the pressure gauge and turns off the apparatus when the pressure reaches the specified pressure specified for car models.

Patent Document 1: Japanese Laid-open Patent Publication No. 2005-344570.

DISCLOSURE OF THE INVENTION

Problem to be Solved by the Invention

Using the pressure gauge, however, it is unclear for the user to know whether the pressure reaches the specified pressure. Therefore, there are problems that an assessment of the user is apt to vary widely and that it is difficult to fill up the tire with the air at the specified pressure with high accuracy. Moreover, when filling the tire with too much air, an operation for pressure reduction needs excessive operation; it incurs increase of working hours.

It is therefore an object of the present invention to provide a compressor apparatus being capable of notifying a user that definitely whether compressed-air reaches the specified pressure or not, reducing the assessment variance of the user, and filling up the tire with the air at the specified pressure with a high degree of accuracy while eliminating a pressure gauge and reducing costs, on a basis of utilizing a conventional relief valve hitherto used, which has been as a safety valve, as a detection means.

Means for Solving the Problems

To achieve the above-mentioned object, the invention set forth in claim 1 of the present application is that a compressor apparatus, in a storage case, comprises a motor; a rotational shaft rotary-driven by the motor; a compressor main body comprising a rod attached to the rotational shaft via a crank, a piston disposed in the rod end, and a cylinder housing reciprocatingly the piston and forming a cylinder chamber for compressing the air between the above-mentioned piston and the cylinder; an air-supplying means having an air-supplying flow channel to supply the compressed-air from the above-mentioned cylinder chamber into the tire; and a detection means which notifies a user that a pressure of the compressed-air supplied from the above-mentioned cylinder chamber exceeds a reference pressure and prompts the user to turn off the above-mentioned motor. The above-mentioned detection means includes a valve main body having a valve flow channel comprising one end leading to the air-supplying flow channel and another end leading to an exhaust port, and an switch valve intermediating in the valve flow channel and releasing the valve flow channel to exhaust the air from the above-mentioned exhaust port when the compressed-air pressure exceeds the above-mentioned reference pressure; a detection cap disposed in the above-mentioned exhaust port and pushed up from a normal position, which is at the same level as an outer surface of the above-mentioned storage case or on the inward side of the outer surface, to a protruding position, which protrudes over the outer surface of the above-mentioned storage case, by the air pressure exhausted from the above-mentioned exhaust port; and a retaining means to keep the above-mentioned detection cap at the above-mentioned normal position when the above-mentioned compressed-air is below the reference pressure.

Effects of the Invention

As above stated, an apparatus according to the present invention comprises a detection means which notifies the user that the pressure of the compressed-air supplied from the cylinder chamber exceeds the reference pressure and prompts the user to turn off the motor, thereby reducing the assessment variance of the user. Therefore, the user can fill up the tire at the nearly specified pressure with a high degree of accuracy.

With respect to the above-mentioned detection means, a conventional relief valve hitherto having been used which was as a safety valve for breakage caused by overpressure as a detection means is utilized for the valve main body. And, the filling pressure of tire specified for car models is set for a reference pressure thereof. Therefore, in the above-mentioned valve main body, when the compressed-air reaches the reference pressure (the filling pressure of tire specified for car models), the compressed-air can be exhausted from the exhaust port. Furthermore, the detection cap is pushed up to the protruding position where the outer surface of the detection cap protrudes over the outer surface of the storage case owing to the above-mentioned exhaust air pressure. Therefore, this can notify the user definitely that the compressed-air exceeds the reference pressure with a smaller movement of the detection cap, that is to say, this can reduce the assessment variance of the user in bringing the motor down. Moreover, the detection means is in an easy structure, and it can eliminate the conventional pressure gauge, thereby reducing costs and downsizing the apparatus.

EXPLANATION OF THE REFERENCES

Figure 1:
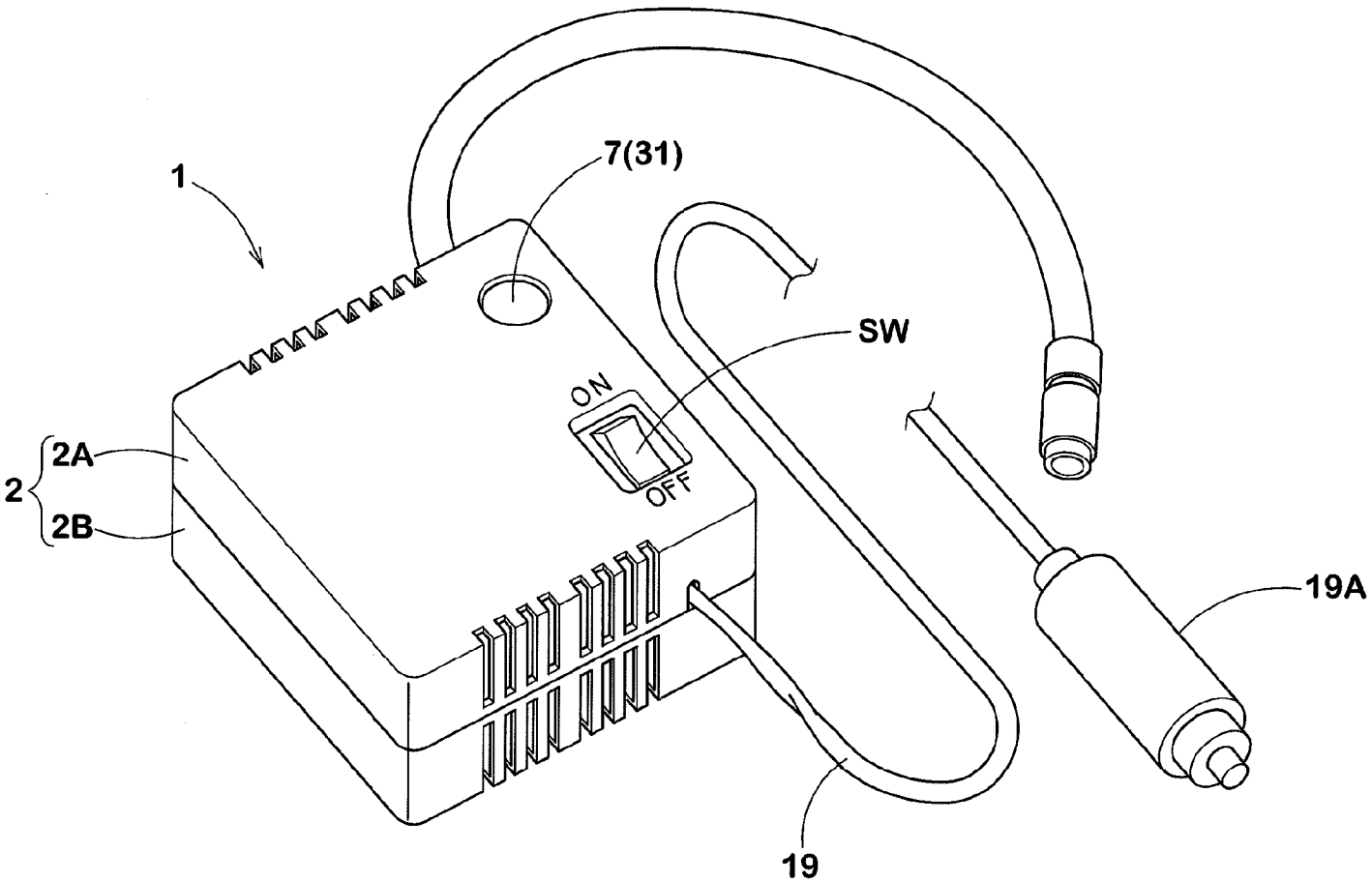
FIG. 1 is a diagrammatic perspective view of a compressor apparatus according to the present invention showing an embodiment.

2 Storage case
7 Detection means
10 Compressor main body
11 Rotational shaft
12 Crank
13 Rod
14 Piston
15 Cylinder chamber
16 Cylinder
18 Air-supplying means
18A Air-supplying flow channel
30 Valve main body
30A Valve flow channel
31 Detection cap
32 Retaining means
33 Exhaust port
34 Switch valve
42 Spring
45 Resonant tube
46 Magnet
M Motor
P Reference pressure
Y1 Normal position
Y2 Protruding position

BEST MODE FOR CARRYING OUT THE INVENTION

Figure 2:
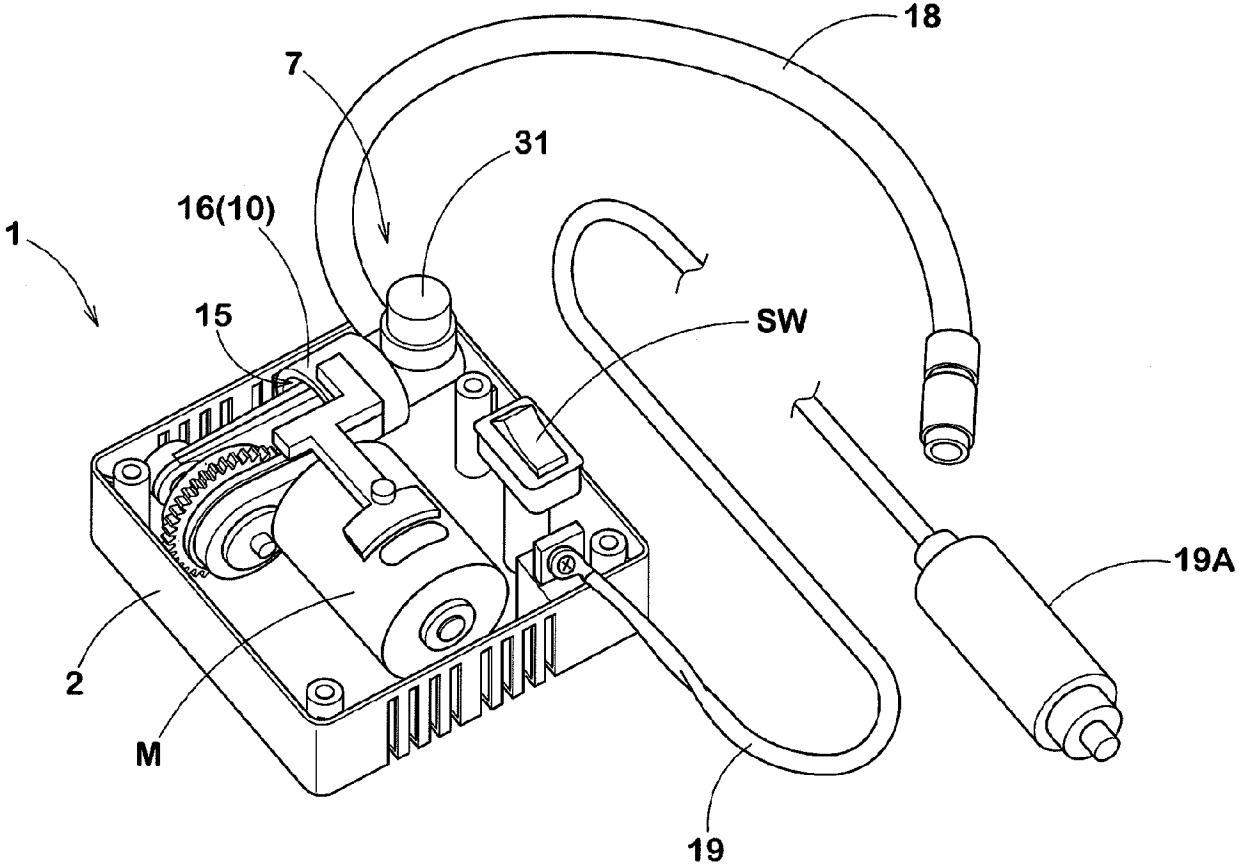
FIG. 2 is a diagrammatic perspective view showing the inside thereof.

Hereinafter, an embodiment of the present invention will be described with referent to the drawings. As illustrated in FIGS. 1 and 2, a compressor apparatus 1 of the present embodiment comprises a storage case 2 including a motor M; a rotational shaft 11 rotary-driven by the motor M; a compressor main body 10 comprising a cylinder chamber 15 to compress the air; an air-supplying means 18 supplying the compressed-air from the above-mentioned cylinder chamber 15 into the tire; and a detection means 7 which notifies a user that a pressure of the compressed-air supplied from the above-mentioned cylinder chamber 15 exceeds a reference pressure P and prompts the user to turn off the above-mentioned motor M.

The above-mentioned storage case 2 is a box object of a transversely low aspect ratio rectangle and, in this example, can be taken to upper and lower case parts 2A and 2B. And, as the above-mentioned motor M, variety commercially available DC motors can be used, which drive in a direct-current power supply of 12 V of an automobile. The motor M is connected to a power-supply cord 19 that has a power-supply plug 19A being connectable to a cigar lighter socket of the car at the distal end via an on-off switch SW attached to a top surface of the above-mentioned storage case 2.

Figure 3:
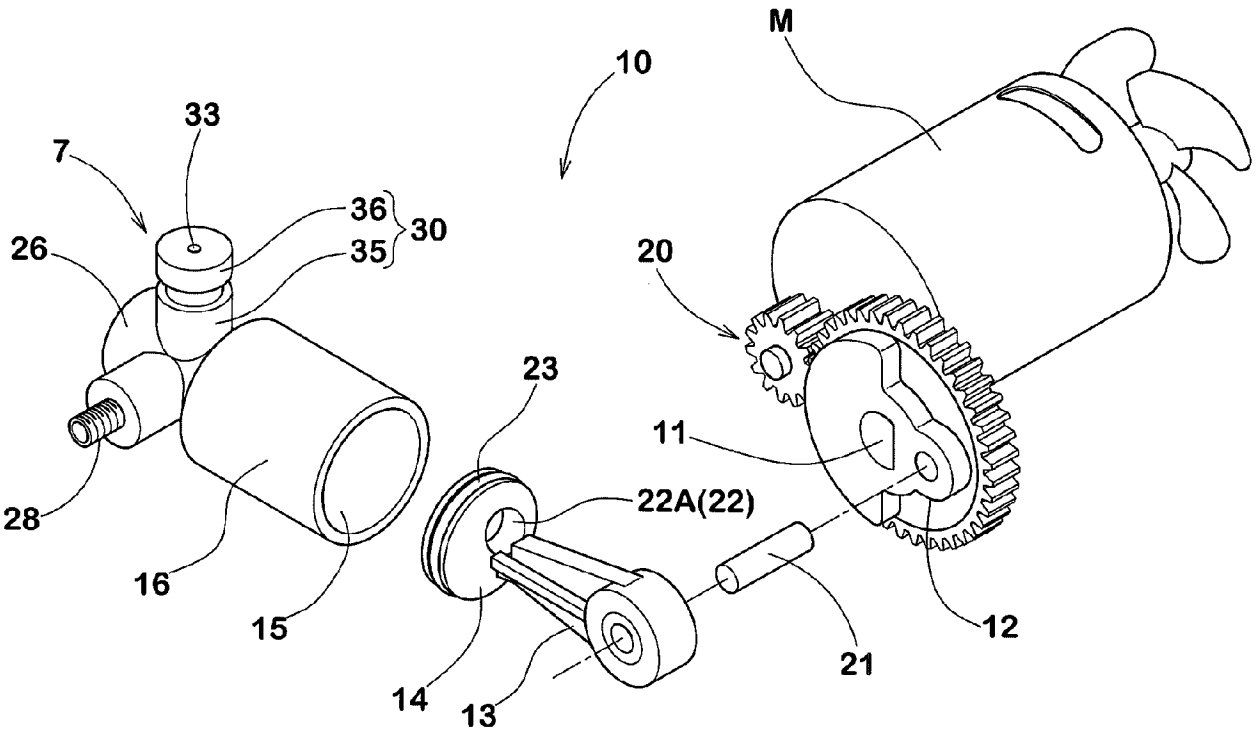
FIG. 3 is an exploded perspective view of a compressor main body.

As shown in FIG. 3, the above-mentioned compressor main body 10 comprises a rod 13 attached via a crank 12 to the rotational shaft 11 rotary-driven by the above-mentioned motor M; a piston 14 disposed in the rod end thereof; and a cylinder 16 housing reciprocatingly the piston 14 and forming a cylinder chamber 15 compressing the air between the above-mentioned piston 14 and the cylinder. Incidentally, between the motor M and the rotational shaft 11, there is a well-known decelerating mechanism 20 comprising a gear, pulley, and the like, for example. The decelerating mechanism 20 slows down a rotation of the motor M as much as approximately from ⅓ to ⅛ and conveys it to the rotational shaft 11.

Figure 4:
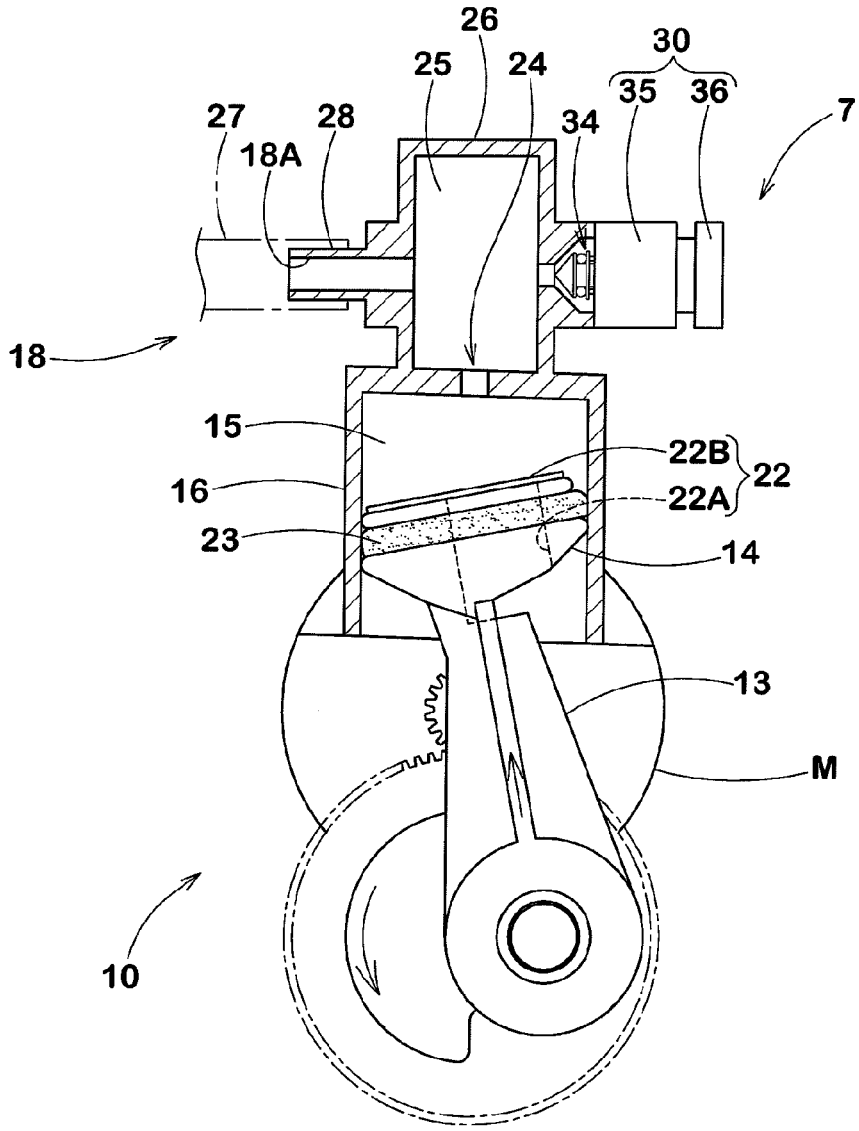
FIG. 4 is a cross-sectional view of the compressor main body in an operating condition.

Moreover, in the above-mentioned crank 12, one end of the above-mentioned rod 13 is pivotably supported via a supporting pin 21. Another end of the rod 13 is provided with a piston 14. In the present example, the above-mentioned rod 13 and the piston 14 are integrally formed as a formed body made of fiber-reinforced plastic. In this example, the piston 14 comprises, as shown in FIGS. 3 and 4, intake valves 22 including an intake bore 22A extending in penetrating the piston 14 in the shaft center direction, a valve element 22B closing the intake bore 22A from a piston front-side, having a spring characteristic, and made of a elastic body such as rubber, synthetic resin, metal and the like. This piston 14 places in the cavity of the above-mentioned cylinder 16 and forms a cylinder chamber 15 being capable of compressing the air between the piston 14 and the cylinder. Incidentally, an outer circumference of the piston 14 is provided with a ring sealant 23, thereby keeping air leakage efficiency between the cylinder 16 and the piston.

In this compressor main body 10, when the above-mentioned piston 14 backs away in a direction of increasing in content of the cylinder chamber 15, the above-mentioned intake valve 22 opens and makes inflow from the intake bore 22A into the cylinder chamber 15. And, when the above-mentioned piston 14 gets forward, the above-mentioned intake valve 22 is closed, the air in the above-mentioned cylinder chamber 15 is compressed, and the pressure is enhanced.

The above-mentioned cylinder 16 is jointed to an air-supplying means 18 having an air-supplying flow channel 18A supplying the compressed-air from the cylinder chamber 15 into the tire.

This air-supplying means 18 comprises a surge tank portion 26 having interiorly a surge tank chamber 25 connected to the above-mentioned cylinder chamber 15 via a compressed-air inlet 24. The surge tank chamber 25 retains the compressed-air via the small-opening-like compressed-air inlet 24 and dampens pulsation in pressure caused by the piston 14. Incidentally, the above-mentioned compressed-air inlet 24 can be provided with a check valve. The above-mentioned intake valve 22 can be formed in the cylinder 16. And, the above-mentioned surge tank portion 26 is provided with a nipple-like connecting section 28 protruding forward, for example, to connect releasably to a hose 27 for supplying the compressed-air. The above-mentioned air-supplying means 18 comprises the above-mentioned surge tank portion 26 and the hose 27.

Thus, the compressor apparatus 1 according to the present invention is provided with the detection means 7 that notifies the user that the pressure of the compressed-air supplied from the above-mentioned cylinder chamber 15 exceeds the reference pressure P and prompts the user to turn off the above-mentioned motor M.

Figure 5B:
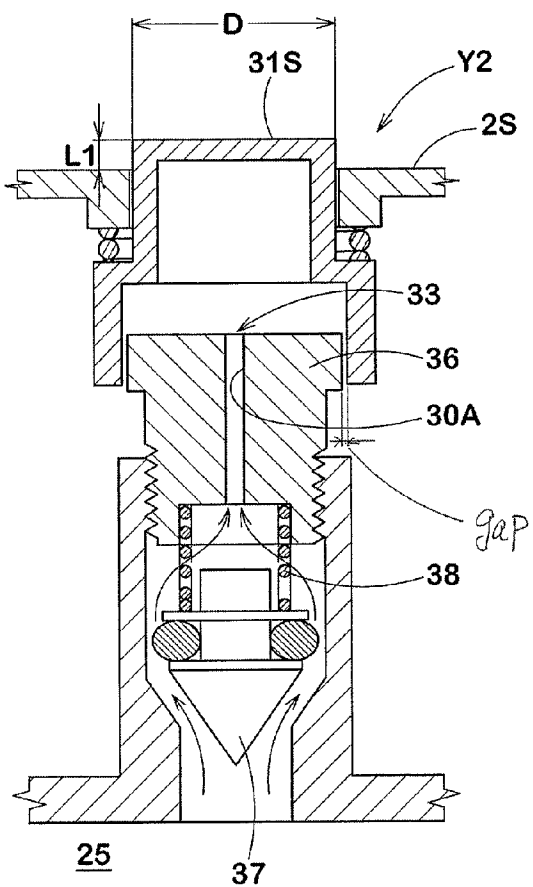
FIGS. 5(*a*) and (*b*) are cross-sectional views of a detection means showing a first embodiment.
Figure 5A:
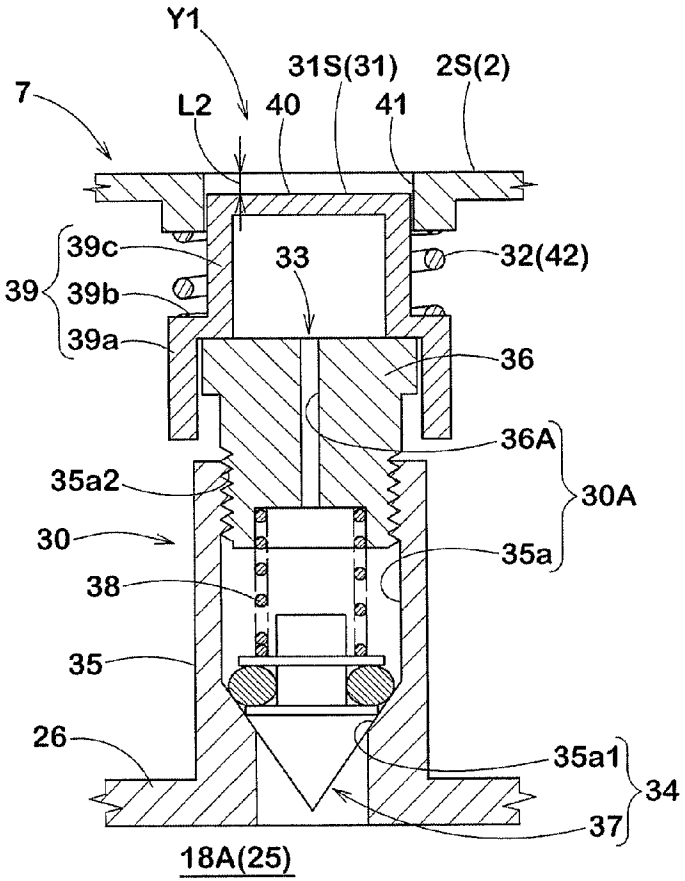

The detection means 7, as shown in FIG. 5, comprises a valve main body 30, a detection cap 31, and a retaining means 32. The above-mentioned valve main body 30 comprises at least a valve flow channel 30A having one end leading to the above-mentioned air-supplying flow channel 18A and another end leading to an exhaust port 33, and a switch valve 34 intermediating in the valve flow channel 30A and releasing the valve flow channel 30A to exhaust the compressed-air supplied from the above-mentioned exhaust port 33 when the compressed-air pressure exceeds the above-mentioned reference pressure P.

More particularly, the valve main body 30 comprises a tubular housing 35 standing out upward from the above-mentioned surge tank portion 26. In a central hole 35*a* of the housing, a tapered cone-shaped valve seat portion 35*a*1 is formed on a lower end side thereof, and an inner threaded portion 35*a*2 is formed on an upper end side thereof. Furthermore, to the inner threaded portion 35*a*2, an adjusting screw 36 is attached spirally. In the above-mentioned central hole 35*a*, a valve shaft 37 to close the above-mentioned valve seat portion 35*a*1 by bringing into contact with the valve seat portion 35*a*1. Moreover, between the above-mentioned adjusting screw 36 and the valve shaft 37, a follow spring 38 forces inferiorly the above-mentioned valve shaft 37 is arranged. In the above-mentioned adjusting screw 36, a connected hole 36A having one end leading to the above-mentioned central hole 35*a* and another end leading to and opening at exhaust port 33 on an upper end face of the above-mentioned adjusting screw 36 is formed. Therefore, the above-mentioned valve flow channel 30A is formed of the above-mentioned central hole 35*a* and the connected hole 36A. And, the switch valve 34 is formed of the above-mentioned valve seat portion 35*a*1 and the valve shaft 37.

In the valve main body 30 is, as shown in FIG. 5(*b*), when the compressed-air pressure in the surge tank chamber 25 increases and exceeds the value of the reference pressure P, the compressed-air is exhausted from the exhaust port 33 through the valve flow channel 30A by overcoming the follow spring 38 and by uplifting the valve shaft 37. In the present invention, the above-mentioned reference pressure P is a tire-filling pressure specified for car models and can be adjusted by rotating in a spiral of the above-mentioned adjusting screw 36 upon request. For example, when the above-mentioned adjusting screw 36 is screwed up, the follow spring 38 is compressed, and the force of repulsion thereof presses inferiorly the switch valve 34 more greatly, thereby heightening the pressure pushing up the switch valve 34. By contraries, when the adjusting screw 36 is loosened, the push-up pressure reduces. The air-filling pressure, namely a reference pressure P can be adjusted by the variation of screwing quantity of the above-mentioned adjusting screw. Incidentally, in the case of the conventional relief valve used as a safety valve, the reference pressure is a safety reference pressure determined to prevent breakage caused by the overpressure of the compressor, so that the conventional relief valve differs from the valve main body 30.

The above-mentioned detection cap 31 is disposed in the above-mentioned exhaust port 33. The detective cap 31 is pushed up from a normal position Y1 where the outer surface 31*s* is at the same level as an outer surface 2*s* of the above-mentioned storage case 2 or is on the inward side of the outer surface 2*s* to the protruding position Y2 where the outer surface 31*s* protrudes over the outer surface 2*s* of the above-mentioned storage case 2 by the air pressure exhausted from the exhaust port 33. This can notify the user visually that the compressed-air exceeds the reference pressure P.

The above-mentioned detection cap 31 is a vessel-like cap and an upper end of the cylindrical body 39 is closed by a plate part 40. In the present embodiment, the cylindrical body 39 has a step and comprises a large-diameter section 39*a* surrounding the above-mentioned adjusting screw 36 and a small-diameter section 39*c* extending on the upper end side thereof via a stepped section 39*b*, for example. In the above-mentioned storage case 2, a guide bore 41 guiding the above-mentioned detection cap 31 in an up-and-down slidable state is formed by inserting movably the above-mentioned cylindrical body 39 (the small-diameter section 39*c*, in this example). Between the outer surface of the above-mentioned stepped section 39*b* and the storage case 2, there is a spring 42 forcing inferiorly the above-mentioned detection cap 31.

Therefore, the above-mentioned detection cap 31 is kept in the normal position Y1 where the inner surface of the above-mentioned stepped section 39*b* abuts on an upper surface of the adjusting screw 36 owing to forcing by the spring 42 when the compressed-air is not more than the reference pressure P. According to the present embodiment, the spring 42 forms the above-mentioned retaining means 32. When the compressed-air exceeds the reference pressure P, the pressure of the exhaust air from the exhaust port 33 overcomes the forcing power of the above-mentioned spring 42 and can push up the detection cap 31 to the above-mentioned protruding position Y2.

And, the above-mentioned detection cap 31 moves from the normal position Y1 where the outer surface 31*s* is at the same level as an outer surface 2*s* of the above-mentioned storage case 2 or on the inward side of the outer surface 2*s*, to the protruding position Y2 where the outer surface 31*s* protrudes over the outer surface 2*s* of the above-mentioned storage case 2. Such a less displacement will allow the user know to perceive and to know a presence of movement of the detection cap 31. Incidentally, to ensure letting the above-mentioned recognition more definitely, a protruding height L1 from the outer surface 2*s* of the outer surface 31*s* in the above-mentioned protruding position Y2 is preferably not less than 2.0 mm, more preferably not less than 3.0 mm. A concave depth L2 of the outer surface 31*s* from the outer surface 2*s* in the normal position Y1 is preferably more than 0 mm, more preferably in a range of from 0.5 to 1.5 mm. Incidentally, the compressor main body 10 vibrates during operation of the apparatus, so that when the above-mentioned protruding height L1 is less than 2.0 mm, it becomes difficult to recognize the protruding of the detection cap 31. When the detection cap 31 is too small, it becomes difficult for the user to recognize the movement. Therefore, a diameter D of the outer surface 31*s* of the above-mentioned detection cap 31 is not less than 5.0 mm. And the user recognizes the movement of the detection cap 31 and stops the motor M. Therefore, it is preferable to dispose the detection cap 31 adjacent to the above-mentioned on-off switch SW.

Figure 7:
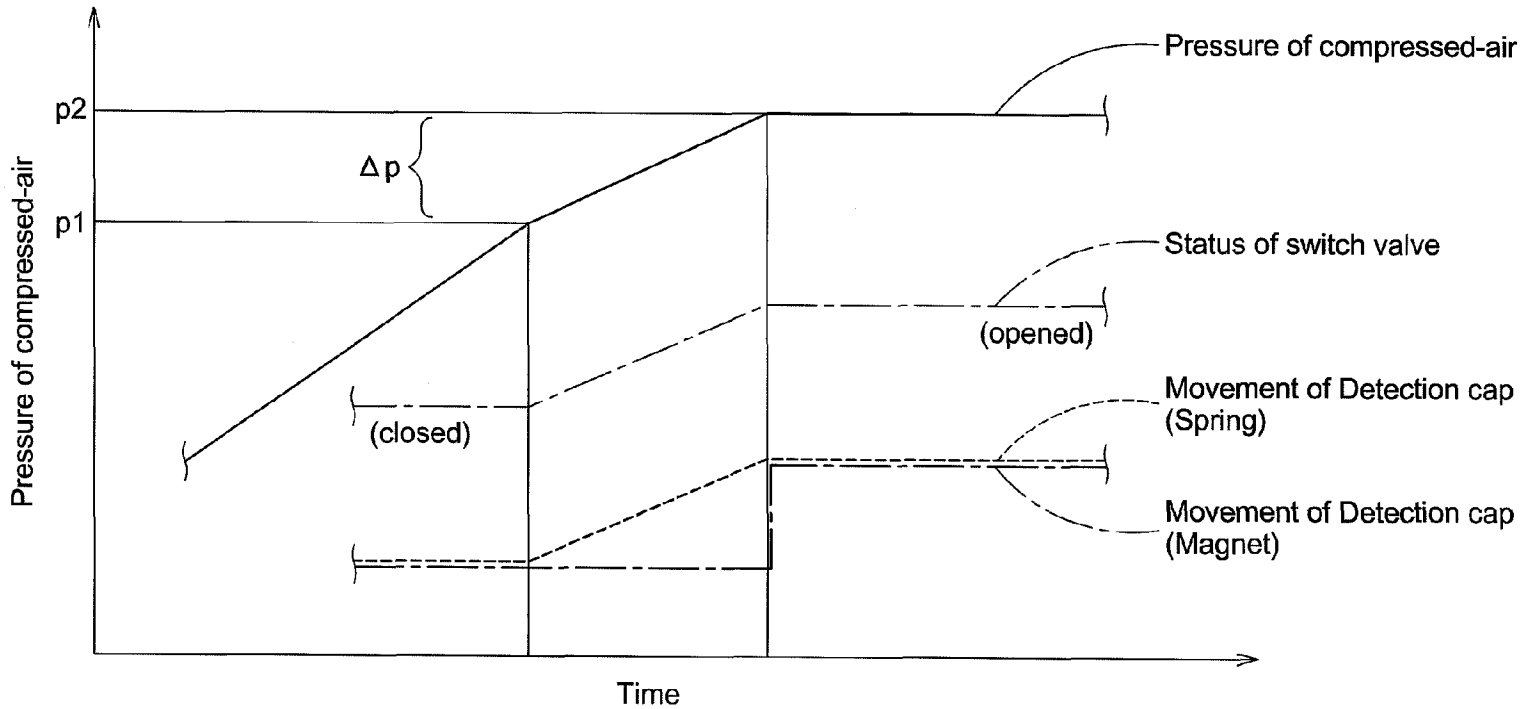
FIG. 7 is a conceptual diagram explaining a relationship between a status of a switch valve and a compressed-air pressure.
Figure 8:
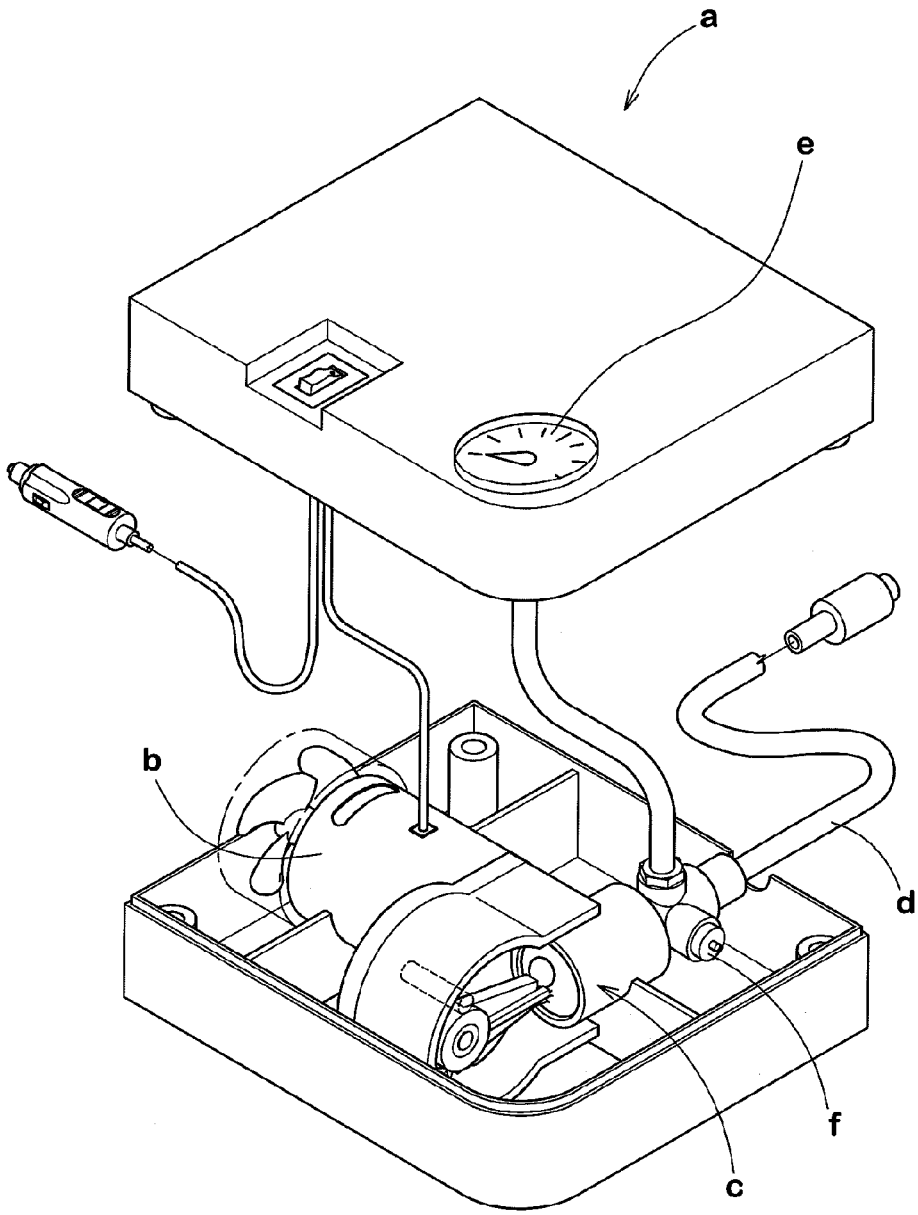
FIG. 8 is a perspective view of a conventional compressor apparatus.

In the above-mentioned valve main body 30, as shown conceptually in FIG. 7, under a condition of not more than a certain pressure p1, the switch valve 34 keeps being closed by a force of the above-mentioned follow spring 38. However, when the pressure reaches the certain pressure p1, the switch valve 34 opens slightly and releases the compressed-air. Thus, with increasing the pressure (p) of the compressed-air, the switch valve 34 opens gradually largely and becomes eventually in a fully open condition (the switch valve 34 opens all the way). Therefore, in the valve main body 30 between the pressure p1 in an initial movement condition of the switch valve 34 and a pressure p2 in the fully open condition, there is a little difference in pressure Δp (delta p).

In contrast, in a case that the detection means 7 according to the first embodiment using the spring 42 as the retaining means 32, the above-mentioned detection cap 31 moves with the movement of the switch valve 34. That is to say, the detection cap 31 repeats momentarily popping up and down, namely in-and-out movement, after reaching the above-mentioned pressure p1. The quantity and period of time of the popped-up are gradually increased. At the pressure p2 under the fully open condition, the detection cap keeps being popped up in the maximum quantity. Therefore, in the first embodiment, the above-mentioned maximum quantity in popped-up is set as a protruding height L1. Furthermore, owing to the difference in pressure Δp, the assessment of the user is likely to vary widely. Then, in the case of the detection means 7 according to the first embodiment, a criterion for assessment is preferably defined as a point of time that the above-mentioned in-and-out movement of the above-mentioned detection cap 31 stops (a time point of the detection cap 31 maximally popped up).

Figure 6B:
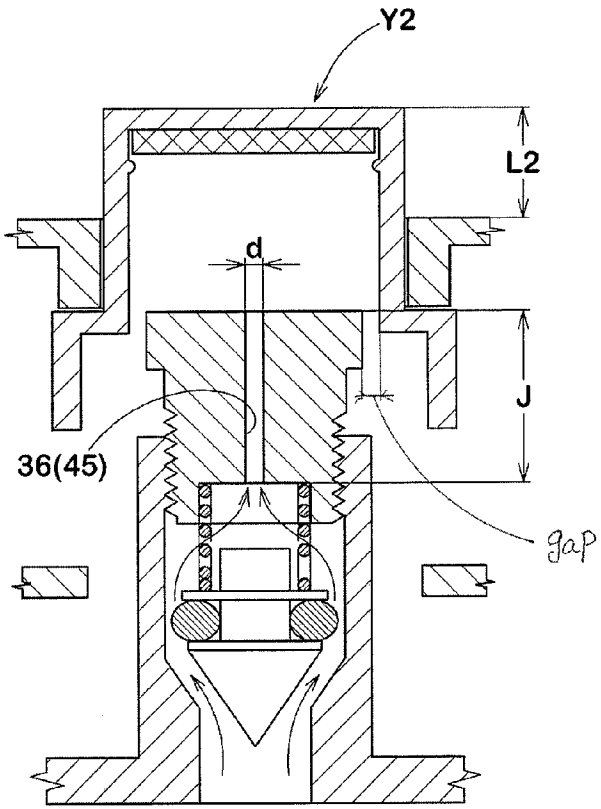
FIGS. 6(*a*) and (*b*) are cross-sectional views of the detection means showing a second embodiment.
Figure 6A:
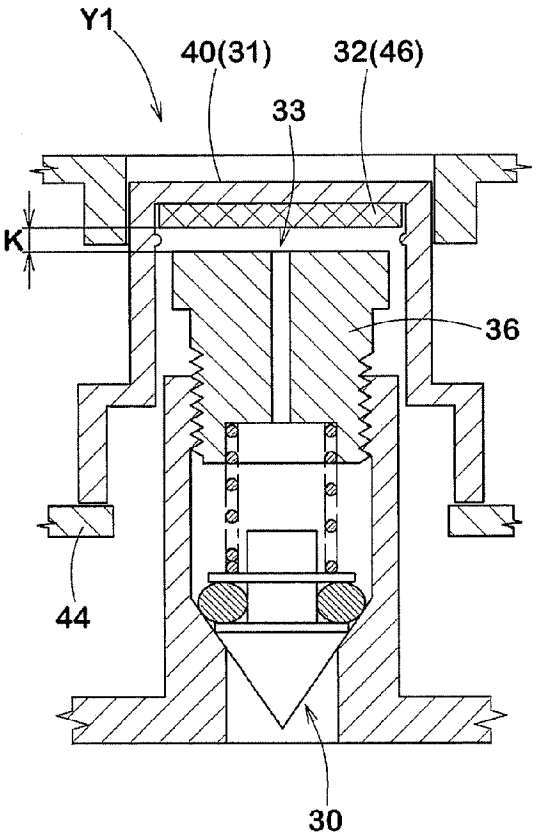

Another embodiment of the detection means 7 (hereinafter referred to as a second embodiment) is shown in FIG. 6. In the present example, the retaining means 32 is formed of a magnet 46 that attaches to a plate part 40 of the above-mentioned detection cap 31 and is suctioned toward the above-mentioned exhaust port 33. More particularly, a lower end of the detection cap 31 abuts on a stopper 44 arranged in the storage case 2, for example, and there is a small gap K between the magnet 46 and the adjusting screw 36. The small gap K is set as a distance where a suction power F between the magnet 46 and the adjusting screw 36 is substantially the same as the pressure p2 at the time of the above-mentioned switch valve 34 being in the fully open condition. Hence, at an initial time of movement of the valve main body 30, the detection cap 31 can stop in the normal position Y1 since the above-mentioned suction power F is large. And, when the valve main body 30 is in a fully open condition and the pressure becomes larger than the suction power F, the above-mentioned detection cap 31 can move at once from the normal position Y1 to the protruding position Y2.

Therefore, in the case of the second embodiment, there is no difference in pressure Δp as the case of the first embodiment. The assessment variance of the user can be reduced preferably to the first embodiment. Meanwhile, FIG. 7 shows conceptually the movement of the detection cap 31 according to the first and second embodiments relating the movement of the switch valve 34.

In the case of the second embodiment, the spring 42 does not affect such as the first embodiment. Thus, the protruding height L1 can be kept 20 mm or more, for example, and this makes the user recognize it definitely. However, when the protruding height L1 exceeds 20 mm, it is not desirable that the storage case 2 grows in size unnecessarily. Therefore, the upper limit of the height L1 is preferably not more than 15 mm, more preferably not more than 10 mm.

In the above-mentioned magnet 46, to make the suction power act stably, it is preferable to form the magnet 16 to have substantially the same diameter as an inner surface of the plate part 40 of the above-mentioned detection cap 31. And, when the magnet 46 is too thick, the magnet gets heavy, and the detection cap 31 shakes up and down at the protruding position Y2; therefore, the recognition gets difficult. Thus, the thickness of the magnet 46 is preferably not more than 3.0 mm, more preferably not more than 2.0 mm, furthermore preferably not more than 1.5 mm. When the magnet 46 is too thin, the detection cap 31 is apt to be pushed up before the fully open condition of the above-mentioned switch valve 34. Therefore, the lower limit of a thickness of the magnet 46 is preferably not less than 1.0 mm.

In the above-mentioned detection means 7 according to the present embodiment, a flow channel portion, namely the above-mentioned connected hole 36A of the above-mentioned valve flow channel 30A on the side of the exhaust port 33, is a resonant tube 45. The exhaust air from the above-mentioned exhaust port 33 generates a high-pitched sound of not less than 2000 Hz (a beep sound hereinafter called, for the sake of expedience). With this arrangement, it can notify the user also aurally that the compressed-air exceeds the reference pressure P, thereby enhancing the recognition effect all the more. For that purpose, a diameter (d) of the above-mentioned resonant tube 45 is preferably set in a range of from 1.2 to 2.5 mm. When the diameter is less than 1.2 mm, a quantity of the exhausted air becomes at a minimum, and a sound pressure of the beep sound is too low to recognize. When the diameter exceeds 2.5 mm, a hit sound by the shaft center float out from the resonant tube 45 loudens, and it becomes difficult to identify the beep sound. When the diameter (d) is much more larger, the beep sound gets not to be generated. And, a length of the above-mentioned resonant tube 45 is an important factor of for the sound pressure of the beep sound. The longer, the length J of not less than 8.0 mm is, the more favorable in the sound pressure is, thereby increasing the recognition performance.

An operating noise generated by the above-mentioned compressor main body 10 is mainly a sound ranging from 800 to 1800 Hz. Therefore, the beep sound of not less than 2000 Hz preferably improves the recognition performance. However, a too high frequency is poorly-heard; therefore, the upper limit of the beep sound is not more than 10000 Hz. In the compressor apparatus 1, the generation of the beep sound makes preferably the sound pressure of the whole sound comprising the operating noise loudens by not less than 1 dB(A). The increase of loudness of less than 1 dB(A) lacks the recognition performance.

Such a resonant tube 45 can be applied in a case that the retaining means 32 is the spring 42. The compressor apparatus 1 according to the present invention can be used not only for air filling of a tire with depressed inner pressure, but also can be used as a compressor apparatus for a puncture repairing system supplying gradually sealant and fill up the air into a punctured tire as the compressor apparatus disclosed in the Japanese Laid-open Unexamined Patent Application Publication No. 2005-344570, for example.

Although especially preferred embodiments of the present invention have been described in detail, the present invention is not limited to the illustrated embodiment, and various modifications can be made.

EMBODIMENT

Compressor apparatuses 1 possessing a structure shown in FIG. 2 were manufactured for trial based on a specification shown Table 1. when a tire having a tire size of 195/65R15 and inflated from zero to a specified inner pressure (250 kPa), the inner pressure at operating time of a detection cap 31 was measured by each compressor apparatus 1.

In each of the compressor apparatus 1, a valve main body 30 was defined so that a reference pressure P was 250 kPa at a fully open condition. The detection cap 31 was 14 mm in outside diameter and 12 mm in inside diameter, and made of nylon resin (red color). A protruding height L1 at a protruding position Y2 was 7 mm. Moreover, in Embodiment 2, a magnet 46 was 12 mm in outside diameter and 1.0 mm in thickness.

TABLE 1

| | Ex. 1 | Ex. 2 |
|---|---|---|
| Retaining means | Spring | Magnet |
| Pressure P1 at beginning of popping-up [kPa] | 220 | 250 |
| Pressure P2 at time of maximum popped-up [kPa] | 250 | 250 |
| Difference in pressure (P2 − P1) [kPa] | 30 | 0 |

In Embodiment 1, there was a difference in pressure by approximately 30 kPa between a pressure p1 at the beginning of popping-up of a detection cap 31 and a pressure p2 at a time point of maximum popped-up. The time point of maximum popped-up was defined as a criterion of turning off a motor, thereby eliminating the variance of the filling up pressure. And, in Embodiment 2, the beginning of popping-up and the time point of maximum popped-up come together; therefore, the user can recognize definitely that the motor turns off.

A diameter (d) of a connected hole 36A in a detection means 7 varied based on a specification shown in Table 2, and the recognition performance with a beep sound was tested when the connected hole 36A was formed as a resonant tube 45. Meanwhile, the recognition performance was tested by feeling of a grader, and valuations were rated on a 4-point scale such as Very Poor—Poor—Good—Very Good. A sound pressure was measured with use of a microphone 50 cm superiorly apart from the compressor apparatus 1. A length J of the connected hole 36A was 8.0 mm, and an inside diameter of a central hole 35*a* of a housing 35 was 8.0 mm.

TABLE 2

| | Ex. 3 | Ex. 4 | Ex. 5 | Ex. 6 | Ex. 7 | Ex. 8 | Ex. 9 |
|---|---|---|---|---|---|---|---|
| Diameter (d) of Connected hole (resonant tube) [mm] | 1.0 | 1.2 | 1.5 | 2.0 | 2.5 | 3.0 | 3.5 |
| Sound pressure just before generating beep sound [dB(A)] | 87.6 | 88.3 | 89.0 | 89.5 | 89.9 | 91.5 | 93.1 |
| Sound pressure at a time point of generating beep sound [dB(A)] | 87.9 | 89.4 | 91.3 | 92.0 | 92.0 | 92.2 | Silent |
| Difference in sound pressure [dB(A)] | 0.3 | 1.1 | 2.3 | 2.5 | 2.1 | 0.7 | — |
| Recognition performance of beep sound | Very Poor | Good | Very Good | Very Good | Good | Very Poor | Very Poor |

As shown in Table 2, the difference in sound pressure is increased when the diameter (d) ranges from 1.2 to 2.5 mm, thereby recognizing an improvement of the recognition performance.

The invention claimed is:

1. A compressor apparatus comprising, in a storage case, a motor;

a rotational shaft that is rotationally driven by the motor;

a compressor main body comprising a rod attached to the rotational shaft via a crank, a piston disposed at an end of the rod, and a cylinder housing that receives at one end the piston, allows the piston to move in a reciprocating manner, and forms a cylinder chamber for compressing air between said piston and the other end of the cylinder housing;

an air-supplying means having an air-supplying flow channel to supply the compressed-air from said cylinder chamber into a tire; and a detection means which notifies a user that a pressure of the compressed-air supplied from said cylinder chamber exceeds a reference pressure and prompts the user to turn off said motor;

wherein said detection means includes a valve main body having a valve flow channel including one end leading to the air-supplying flow channel and another end leading to an exhaust port, and a switch valve intermediating in the valve flow channel and releasing the valve flow channel to exhaust the air from said exhaust port when the compressed-air pressure exceeds said reference pressure;

a detection cap disposed in said exhaust port and on an upper portion of the valve main body, said detection cap comprising a cylindrical body and a plate part that closes an upper end of said cylindrical body, and said detection cap having a normal position, which is at a same level as an outer surface of said storage case or on an inward side of the outer surface of said storage case, or being pushed up to a protruding position, which protrudes over the outer surface of said storage case, by the air pressure exhausted from said exhaust port, and a retaining means to keep said detection cap at said normal position when said compressed-air is below the reference pressure, and a gap for exhausting air from the exhaust port is provided between an outer peripheral surface of the valve main body and an inner peripheral surface of the cylindrical body of the detection cap.

2. The compressor apparatus as set forth in claim 1, wherein said reference pressure is an air-filling pressure of the tire.

3. The compressor apparatus as set forth in claim 1 or 2, wherein said retaining means is a spring that forces said detection cap toward said normal position.

4. The compressor apparatus as set forth in claim 1 or 2, wherein said retaining means is a magnet attached to said detection cap and attracted toward said exhaust port.

5. The compressor apparatus as set forth in claim 1, wherein, in said detection means, a flow channel portion of said valve flow channel on the side of the exhaust port is a resonant tube, and the exhaust air from said exhaust port generates a high-pitched sound of not less than 2000 Hz.

* * * * *